US011982082B2

(12) United States Patent
Meether et al.

(10) Patent No.: US 11,982,082 B2
(45) Date of Patent: May 14, 2024

(54) OUTDOOR BUILDING HAVING JOIST ASSEMBLY

(71) Applicant: LEISURE TIME PRODUCTS, LLC, Pittsburg, KS (US)

(72) Inventors: Stuart L. Meether, Wichita, KS (US); Jess R. Bogle, Pittsburg, KS (US)

(73) Assignee: Leisure Time Products, LLC, Pittsburg, KS (US)

( * ) Notice: Subject to any disclaimer, the term of this patent is extended or adjusted under 35 U.S.C. 154(b) by 22 days.

(21) Appl. No.: 17/862,997

(22) Filed: Jul. 12, 2022

(65) Prior Publication Data

US 2023/0017313 A1 Jan. 19, 2023

Related U.S. Application Data

(60) Provisional application No. 63/221,304, filed on Jul. 13, 2021.

(51) Int. Cl.
*E04B 1/58* (2006.01)
*E04B 1/38* (2006.01)

(52) U.S. Cl.
CPC ..... *E04B 1/5831* (2013.01); *E04B 1/388* (2023.08); *E04B 2001/5856* (2013.01)

(58) Field of Classification Search
CPC ..... E04B 1/5831; E04B 1/388; E04B 2001/5856; E04B 2001/2415; E04B 2001/2451; E04B 2001/2457
See application file for complete search history.

(56) References Cited

U.S. PATENT DOCUMENTS 4,570,408 A * 2/1986 Frascaroli ..... E04B 1/5831 52/843
4,614,502 A * 9/1986 Nelson ..... A63F 9/088 52/645
4,723,384 A * 2/1988 Mengeringhausen .... E04B 1/24 52/646
5,203,135 A * 4/1993 Bastian ..... F16B 7/0413 403/292
6,327,823 B1 * 12/2001 Emms ..... E04B 1/2403 52/273
6,810,628 B2 * 11/2004 Emms ..... E04C 3/40 52/93.2
6,874,971 B2 * 4/2005 Albaugh ..... F16B 2/04 403/368
7,832,180 B2 * 11/2010 Dolby ..... E04B 2/96 52/235
9,932,734 B1 * 4/2018 Winter ..... E04B 1/1903
10,017,934 B2 * 7/2018 Getz ..... E04B 1/2403

(Continued)

*Primary Examiner* — Rodney Mintz
(74) *Attorney, Agent, or Firm* — Frost Brown Todd LLP

(57) ABSTRACT

An internal splice joint that facilitates coupling of a pair of joist members together is provided. The internal splice joint includes a main wall, first and second side flanges, and first and second end flanges. The first side flange extends upwardly from the main wall. The second side flange extends upwardly from the main wall and is spaced from the second side flange. The first end flange extends from the first side flange. The second end flange extends from the second side flange. The first end flange and the second end flange extend inwardly towards each other and are spaced from each another. A joist assembly that includes the internal splice joint is also provided.

8 Claims, 9 Drawing Sheets

(56) References Cited

U.S. PATENT DOCUMENTS 10,024,048 B2 * 7/2018 Getz ..... E04B 9/065
10,214,938 B2 * 2/2019 Pan ..... E04H 15/58
10,316,508 B1 * 6/2019 Hendry ..... E04B 1/5831
10,364,565 B1 * 7/2019 Jackson ..... E04G 23/0237
10,405,657 B2 * 9/2019 McKenzie ..... A47B 21/06
10,738,457 B1 * 8/2020 Hendry ..... E04B 1/1903
10,760,280 B2 * 9/2020 Pan ..... E04F 10/02
11,098,476 B2 * 8/2021 Jin ..... E04B 1/2403
11,377,840 B2 * 7/2022 Stephan ..... E04C 3/07
11,447,955 B2 * 9/2022 Pan ..... E04H 15/58
11,781,317 B2 * 10/2023 Meether ..... E04B 1/0046
52/93.1
2003/0031077 A1 * 2/2003 Emms ..... E04C 3/40
365/230.03
2007/0227080 A1 * 10/2007 Tseng ..... E04F 10/08
52/78
2010/0107544 A1 * 5/2010 Gray ..... F16B 12/42
52/592.1
2012/0291261 A1 * 11/2012 Davis ..... F16B 12/50
403/292
2014/0165499 A1 * 6/2014 Vanker ..... E04C 3/07
29/897
2017/0233995 A1 * 8/2017 Abernathy ..... E04B 1/2403
52/845
2017/0233996 A1 * 8/2017 Abernathy ..... F16B 7/0433
52/698
2017/0335595 A1 * 11/2017 Pan ..... E04H 15/58
2018/0094418 A1 * 4/2018 Winter ..... E04B 1/2403
2018/0094422 A1 * 4/2018 Getz ..... E04B 7/16
2018/0094423 A1 * 4/2018 Getz ..... E04B 9/065
2018/0238042 A1 * 8/2018 Collins ..... E04G 23/0218
2018/0332964 A1 * 11/2018 McKenzie ..... A47B 96/067
2019/0136538 A1 * 5/2019 Pan ..... E04D 5/00
2020/0399905 A1 * 12/2020 Pan ..... E04H 15/54
2021/0156135 A1 * 5/2021 Stephan ..... H02S 30/00
2022/0081900 A1 * 3/2022 Meether ..... E04B 1/388
2023/0077674 A1 * 3/2023 Pan ..... E04H 15/34

* cited by examiner

OUTDOOR BUILDING HAVING JOIST ASSEMBLY

REFERENCE TO RELATED APPLICATION

This application claims priority of U.S. provisional patent application Ser. No. 63/221,304, entitled OUTDOOR BUILDING HAVING JOIST ASSEMBLY, filed Jul. 13, 2021, and hereby incorporates this provisional patent application by reference herein in its entirety.

TECHNICAL FIELD

A pergola or other building is provided and includes a plurality of joist assemblies. Each joist assembly includes a pair of joist members that are coupled together with an internal splice joint.

BACKGROUND

Conventional pergolas or other outdoor buildings typically include continuous beam joists for directly or indirectly supporting roof components. These continuous beam joists are formed as a unitary one piece construction and are thus difficult and expensive to ship.

BRIEF DESCRIPTION OF THE DRAWINGS

It is believed that certain embodiments will be better understood from the following description taken in conjunction with the accompanying drawings in which.

DETAILED DESCRIPTION

Figure 1:
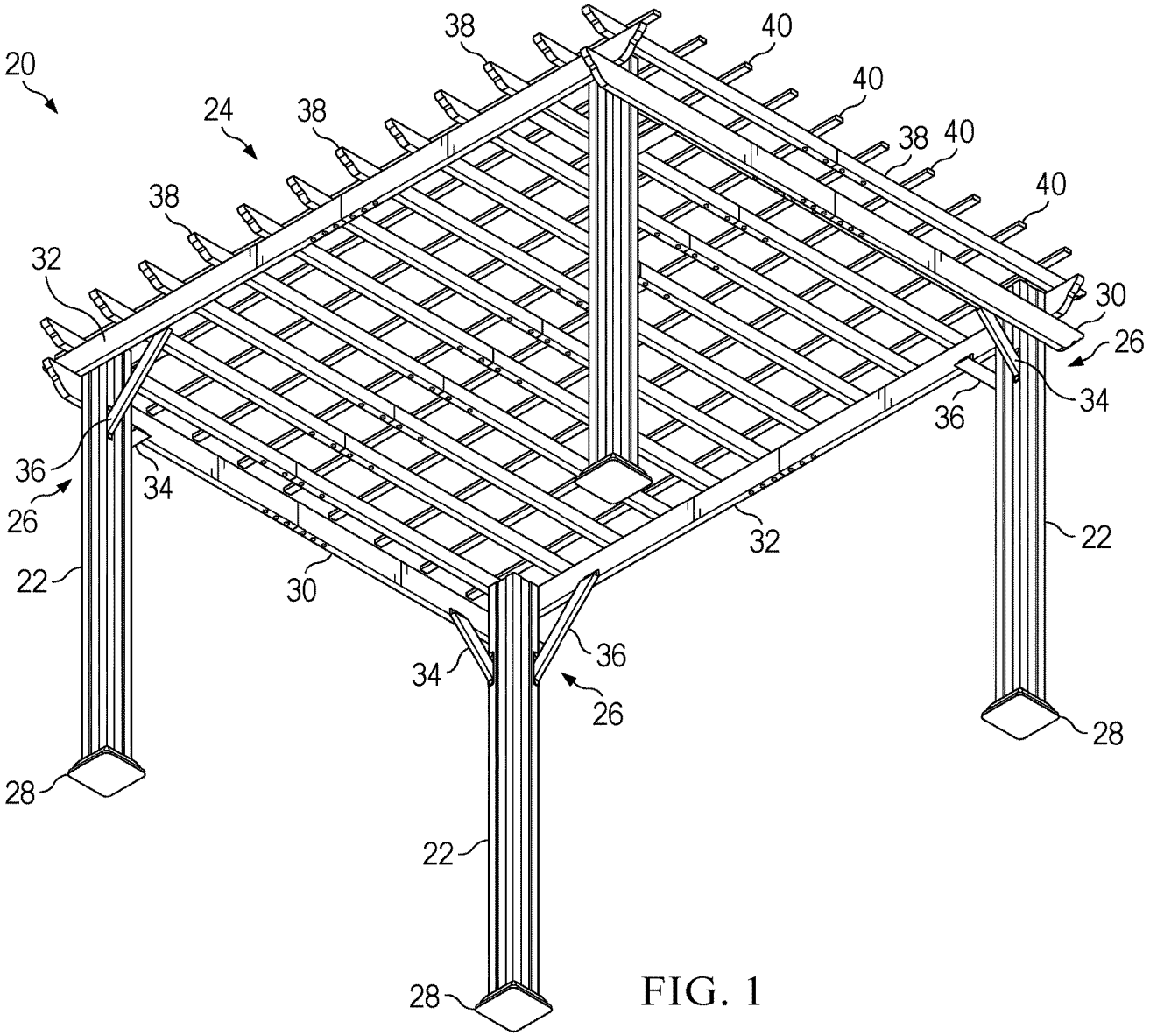
FIG. 1 is an isometric view depicting a pergola having a plurality of lower joist assemblies, a plurality of upper joist assemblies, and a plurality of roof joist assemblies.

In connection with the views and examples of FIGS. 1-9, wherein like numbers indicate the same or corresponding elements throughout the views, FIG. 1 illustrates a pergola 20 that comprises a plurality of vertical posts 22 and a roof structure 24 that is supported, at least in part, by the vertical posts 22. Each of the vertical posts 22 can have an upper end 26 that supports the roof structure 24 and a lower end 28 that can be installed on a ground surface (e.g., a concrete pad). The pergola 20 can include a pair of lower joist assemblies 30 and a pair of upper joist assemblies 32. Each of the lower and upper joist assemblies 30, 32 can extend between and can be coupled with respective pairs of the vertical posts 22. The lower joist assemblies 30 can be positioned beneath the upper joist assemblies 32 and can provide underlying support for the upper joist assemblies 32. A plurality of lower braces 34 can extend between the lower joist assemblies 30 and the vertical posts 22. A plurality of upper braces 36 can extend between the upper joist assemblies 32 and the vertical posts 22. In one embodiment, the vertical posts 22, the lower and upper joist assemblies 30, 32, and the lower and upper braces 34, 36 can be formed of metal, such as aluminum or stainless steel, but in other embodiments, can be formed of any of a variety of suitable alternative materials, such as, for example, wood or a wood and thermoplastic composite material. It is to be appreciated that, although a pergola is shown and described herein, other buildings are contemplated, such as, for example, a gazebo, a pavilion, or a pole building.

The roof structure 24 can include a plurality of roof joist assemblies 38 and a plurality of purlins 40 that overlie the roof joist assemblies 38 and are substantially perpendicular to the roof joist assemblies 38. Each of the roof joist assemblies 38 can extend between, and can be coupled with, the upper joist assemblies 32 such that the upper joist assemblies 32 provide underlying support for the roof joist assemblies 38 and thus the roof structure 24 as a whole. The purlins 40 can extend between, and can be coupled with, the roof joist assemblies 38 such that the roof joist assemblies 38 provide underlying support for the purlins 40. In one embodiment, the roof structure 24 can be formed of metal, such as aluminum or stainless steel, but in other embodiments, can be formed of any of a variety of suitable alternative materials, such as, for example, wood or a wood and thermoplastic composite material.

Figure 2:
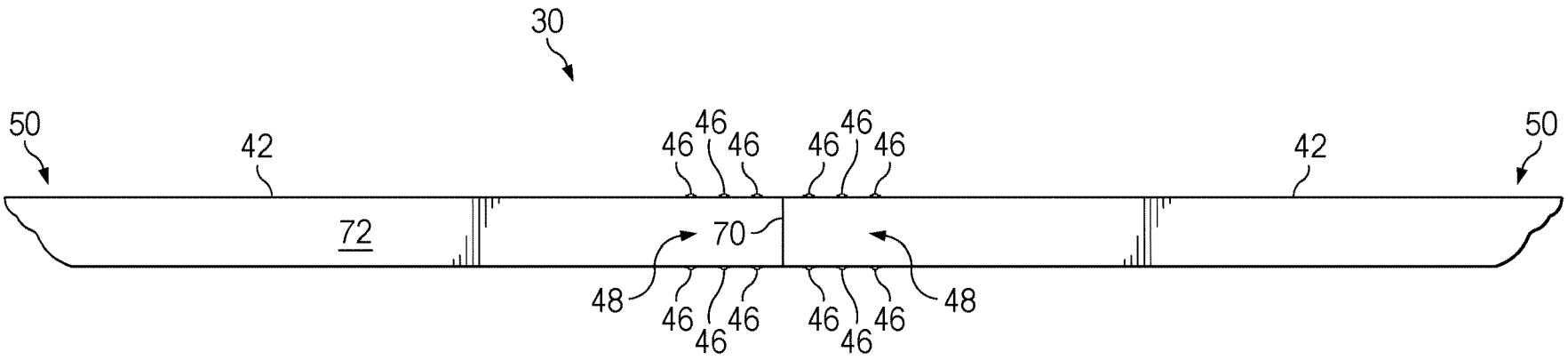
FIG. 2 is a front elevation view of one of the lower joist assemblies of FIG. 1.
Figure 3:
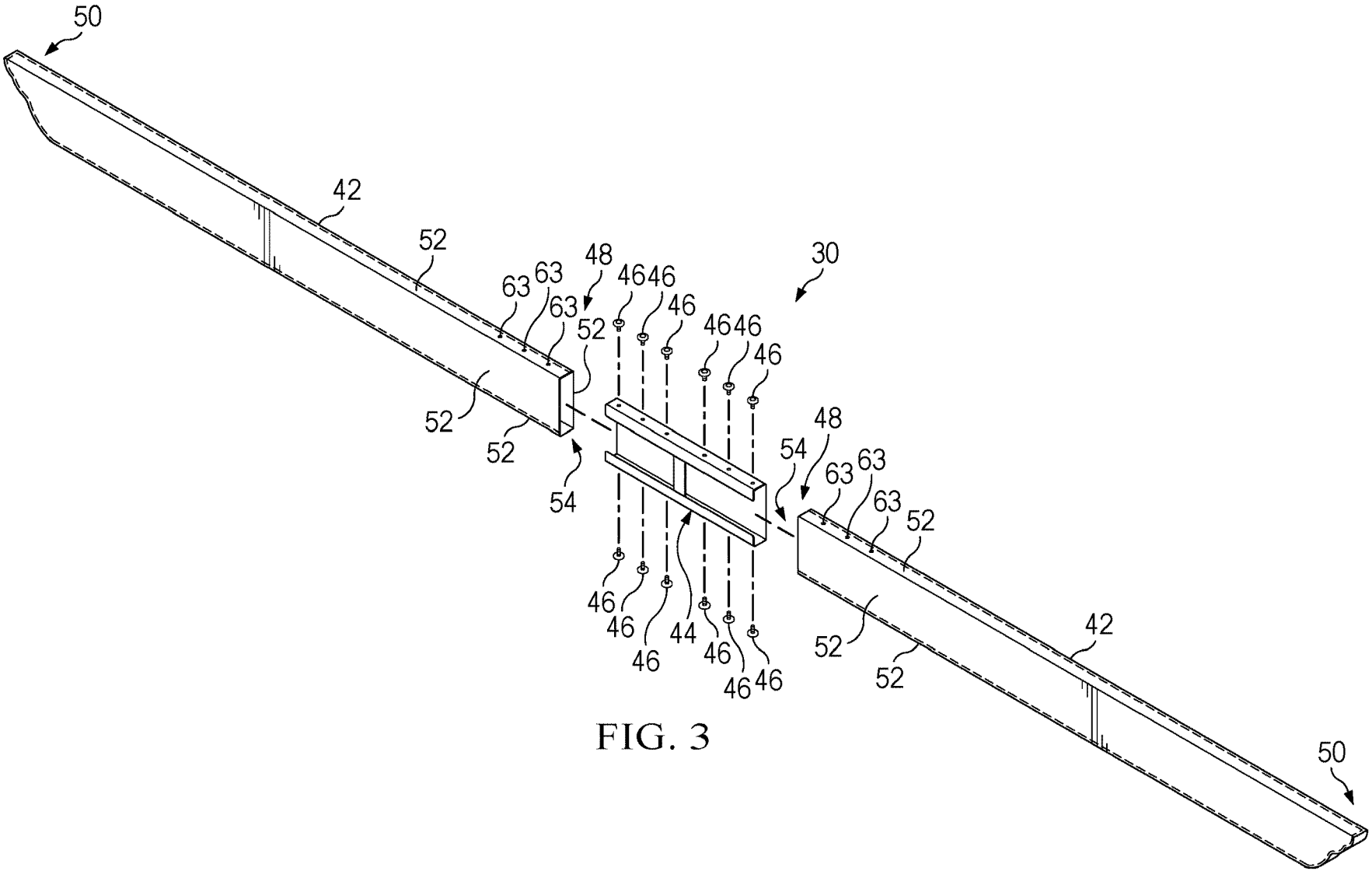
FIG. 3 is an exploded view of the lower joist assembly of FIG. 2.
Figure 4:
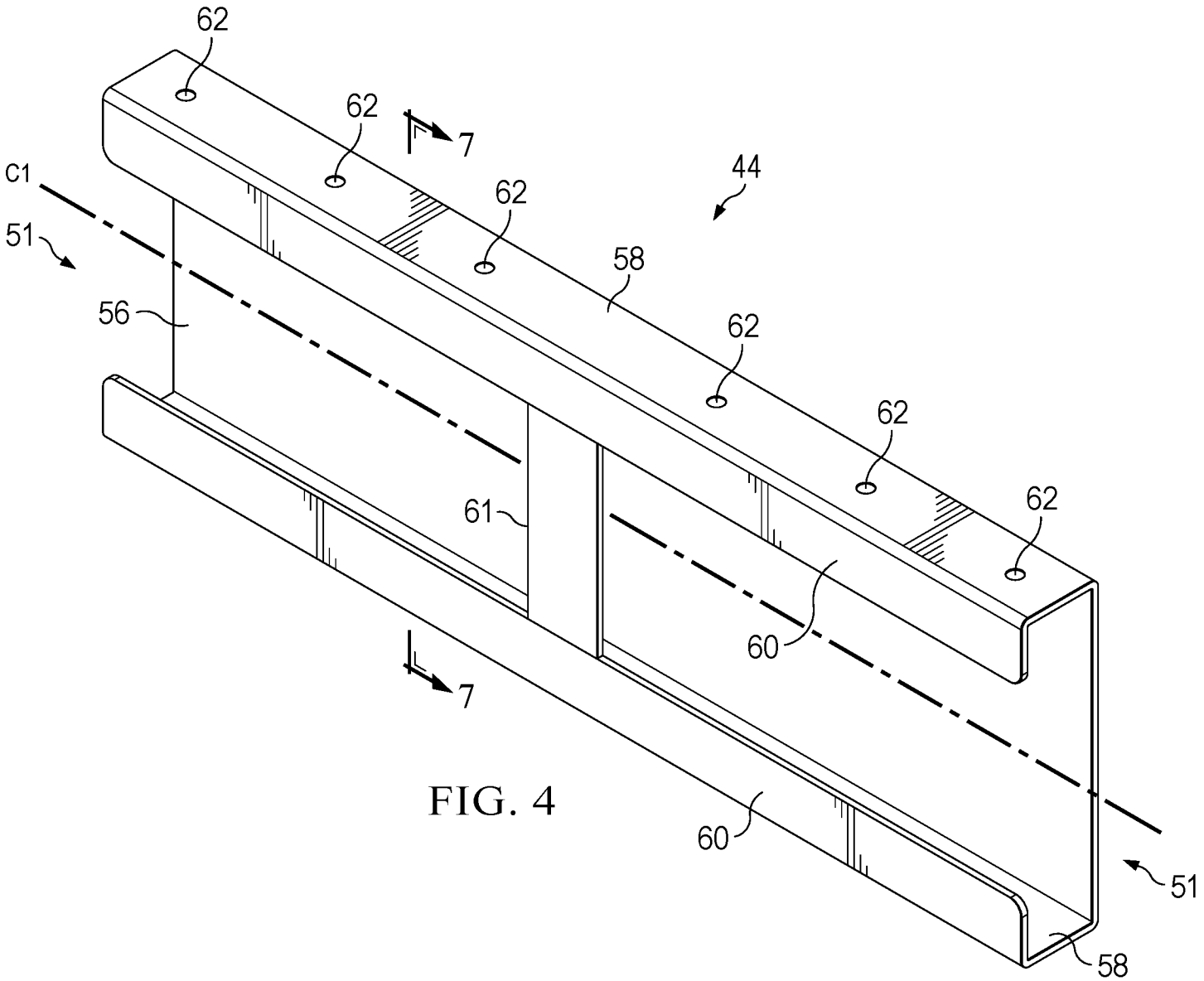
FIG. 4 is an upper isometric view depicting an internal splice joint of the lower joist assembly of FIG. 2.

Referring now to FIGS. 2-5, one of the lower joist assemblies 30 will now be described and can be understood to be a representative example of both lower joist assemblies 30 shown in FIG. 1. As illustrated in FIG. 3, the lower joist assembly 30 can include a pair of joist members 42 and an internal splice joint 44 that are coupled together with a plurality of threaded fasteners 46. Each of the joist members 42 can include a proximal end 48 and a distal end 50. The internal splice joint 44 can include opposing ends 51 (FIG. 4). Each of the joist members 42 can include a plurality of wall portions 52 that cooperate to define a receptacle 54 at the proximal end 48 that is configured to receive one of the opposing ends 51 of the internal splice joint 44. In one embodiment, as illustrated in FIG. 3, each joist member 42 can be formed from a hollow material, such as hollow steel or thermoplastic, such that the receptacle 54 extends throughout the joist member 42 (e.g., to the distal end 50). In another embodiment, each joist member 42 can be formed of a solid material, such as wood, such that each receptacle 54 is only formed in the proximal end 48 of the joist member 42 (e.g., via a routing or CNC process) and does not extend through to the distal end 50.

Figure 5:
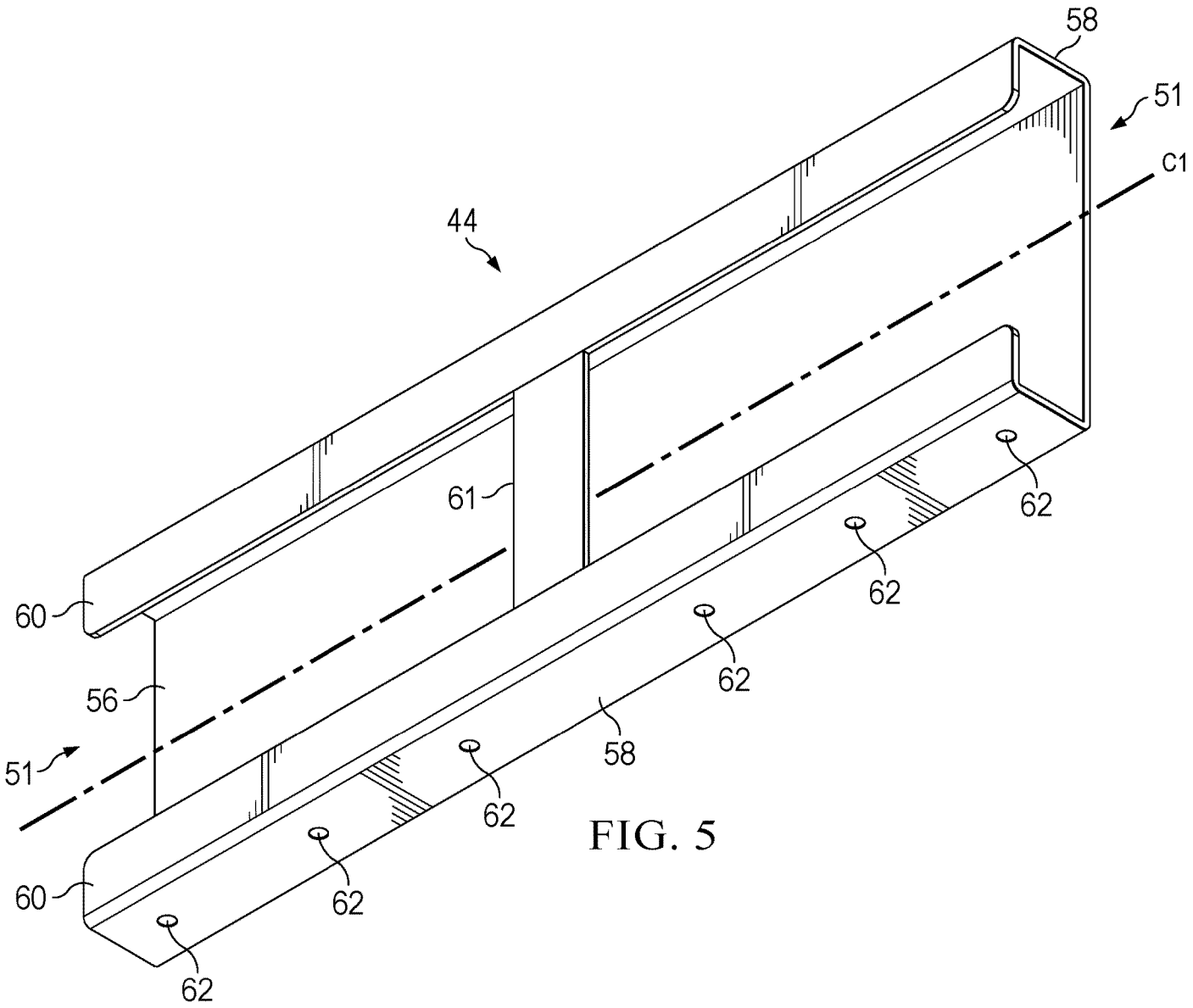
FIG. 5 is a lower isometric view of the internal splice joint of FIG. 4.

As illustrated in FIGS. 4 and 5, the internal splice joint 44 can include a main wall 56, a pair of side flanges 58, and a pair of end flanges 60. The main wall 56 can be substantially planar. The pair of side flanges 58 can extend upwardly from the main wall 56 and can be spaced from each other. In one embodiment, each of the side flanges 58 can extend substantially orthogonally to the main wall 56 (e.g., by an angle of between about 85 degrees and 95 degrees). Each of the end flanges 60 can extend from respective ones of the side flanges 58 and can be spaced from each other. In one embodiment, each of the end flanges 60 can extend inwardly towards each other and substantially orthogonally to respective ones of the side flanges 58 (e.g., by an angle of between about 85 degrees and 95 degrees). The end flanges 60 can be spaced from each other. The main wall 56, the pair of side flanges 58, and the pair of end flanges 60 can accordingly be arranged relative to each other such that the internal splice joint 44 is substantially c-shaped at a cross-section taken orthogonal to a centerline C1 (see FIG. 7).

A brace member 61 can extend between the end flanges 60 and can be coupled thereto (e.g., via welding or fasteners (not shown)) to enhance the overall structural integrity of the internal splice joint 44 between the end flanges 60. The brace member 61 can be a flat elongate member that is disposed along an interior of the end flanges 60 such that the brace member 61 is positioned between the main wall 56 and the end flanges 60. It is to be appreciated that the internal splice joint 44 can be formed of metal (e.g., aluminum or steel), thermoplastic, wood, or any of a variety of suitable alternative materials and that the material selected for the internal splice joint 44 can be the same as, or different from, the material selected for the joist members 42.

Each of the side flanges 58 can define a plurality of threaded apertures 62 that are configured to receive the threaded fasteners 46 (FIG. 2). The proximal ends 48 of each of the joist members 42 can define a plurality of apertures 63 that allow for passage of the threaded fasteners 46 therethrough for threading into the threaded apertures 62 of the internal splice joint 44 to facilitate releasable coupling therebetween. It is to be appreciated that the internal splice joint 44 and the proximal ends 48 of the joist members 42 can be coupled together with any of a variety of suitable alternative releasable or permanent fasteners (e.g., rivets).

Figure 6:
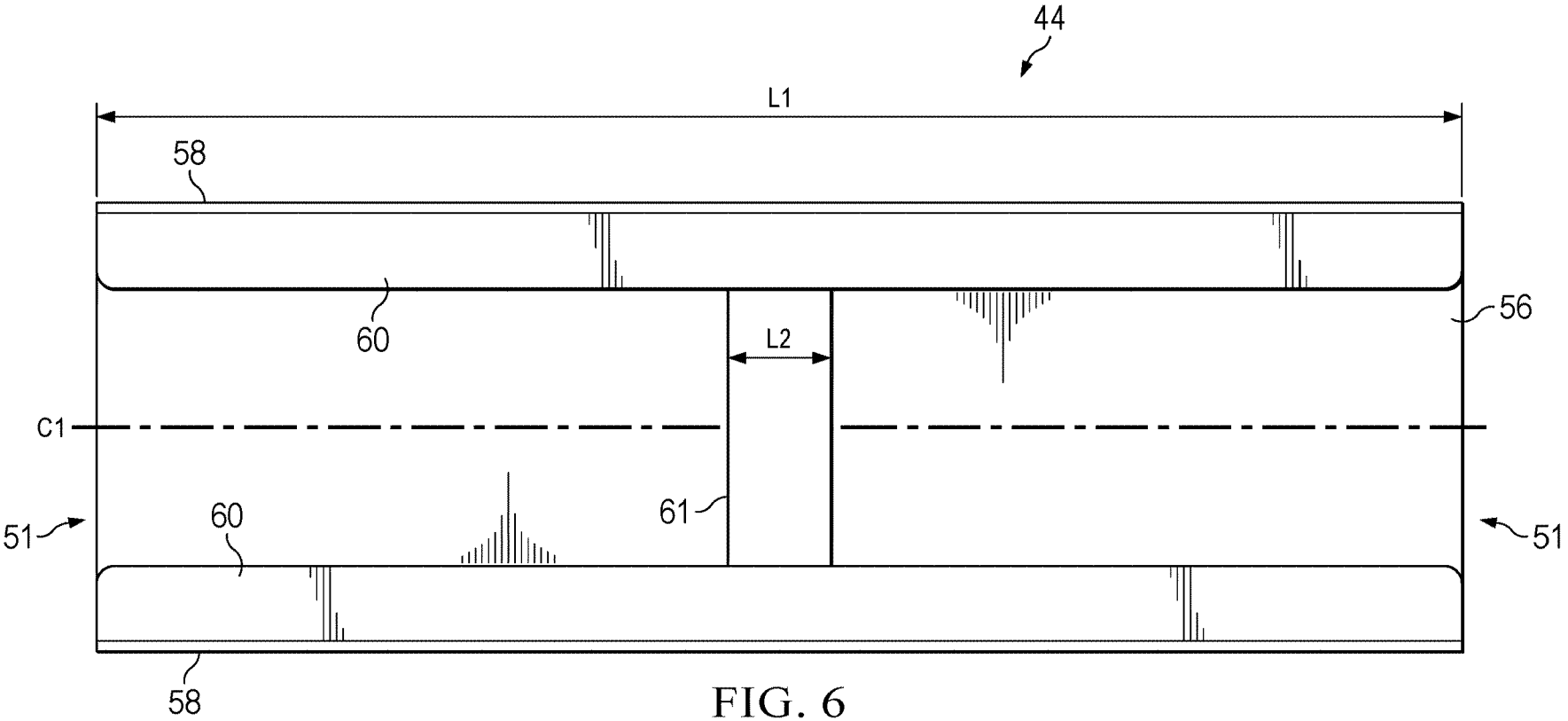
FIG. 6 is a front elevation view of the internal splice joint of FIG. 4.

Referring now to FIG. 6, the internal splice joint 44 can have an overall length L1 that is measured in a direction that is parallel to the centerline C1. In one embodiment, the side flanges 58 can be spaced from each other along the entirety of the overall length L1 and the end flanges 60 can be spaced from each other over the entirety of the overall length L1. The brace member 61 can be centrally located between the opposing ends 51 of the internal splice joint 44 such that the brace member 61 is positioned substantially at the center of the overall length L1 (e.g., equidistant from the opposing ends 51). The brace member 61 can have a length L2 that is measured in a direction that is parallel to the centerline C1. The overall length L1 of the internal splice joint 44 can be at least ten times greater than the length L2 of the brace member 61 (e.g., a ratio of the overall length L1 to the length L2 is at least 10:1).

Figure 7:
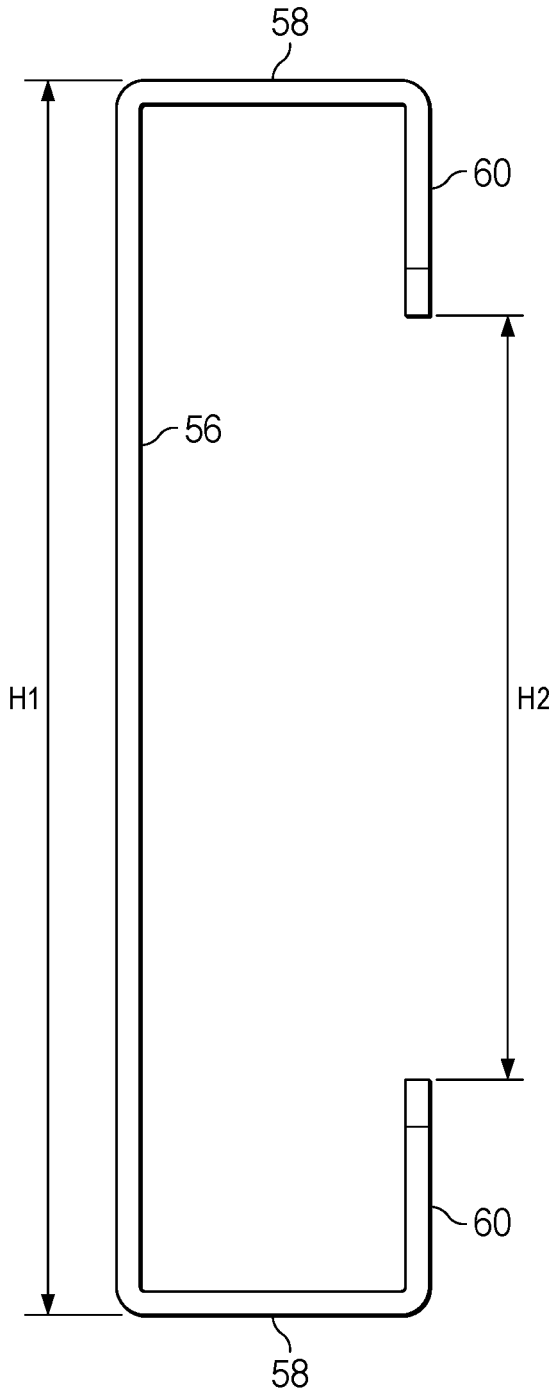
FIG. 7 is a cross section view taken along the line 7-7 in FIG. 4.

Referring now to FIG. 7, the main wall 56 can define a height H1 that is measured orthogonal to the centerline C1. The end flanges 60 can be spaced from each other by a height H2 that is measured orthogonal to the centerline C1. In one embodiment, the height H2 between the end flanges 60 is less than the height H1 of the main wall 56 but is greater than half the height H1 of the main wall 56 (i.e., the ratio of the height H1 to the height H2 is greater than 1:1 but less than 2:1). The internal splice joint 44 can accordingly be devoid of material between the end flanges 60 and the brace member 61 which can reduce the overall weight of the internal splice joint 44 without significantly affecting its overall structural integrity, thereby reducing the overall shipping costs of the pergola 20.

Referring again to FIGS. 2 and 3, the joist members 42 can be coupled together by sliding the proximal ends 48 together such that the internal splice joint 44 extends at least partially (e.g., halfway) into each receptacle 54 and attaching the joist members 42 and the internal splice joint 44 together with the threaded fasteners 46. The proximal ends 48, the internal splice joint 44, and the threaded fasteners 46 can cooperate to create a substantially rigid joint therebetween that is rigid enough such that the lower joist assembly 30 is at least as structurally sound as, and resists deflection and deformation at least as well as, conventional beam joists that are formed as a continuous, unitary, one piece construction (e.g., a continuous piece of lumber, a continuous hollow metal tube, or a continuous hollow thermoplastic tube) typically found in conventional pergolas or other similar outdoor structures for supporting a roof structure. The lower joist assembly 30 can accordingly span the entire length of the pergola 20, which can be over 10 feet long in many cases, without sacrificing the strength typically associated with those conventional beam joists. However, unlike those conventional beam joists, the lower joist assembly 30 is formed of multiple components that can be broken down and packaged into a smaller form factor which can reduce the shipping cost of the joist assembly 30 relative to that of the conventional beam joists.

When the lower joist assembly 30 is assembled, the internal splice joint 44 can be concealed within the receptacles 54 and the proximal ends 48 can be abutted together along a seam 70 (FIG. 2). Each of the proximal ends 48 of the joist members 42 can be shaped such that, when the joist members 42 are abutted against each other, the joist members 42 can mate together in such a way that facilitates concealment of the seam 70 at the joist members 42 such that the lower joist assembly 30 has the appearance of a conventional, unitary, one-piece construction beam. The location of the brace member 61 between the opposing ends 51 of the internal splice joint 44 means that the brace member 61 can underlie at least a portion of the seam 70 to enhance the concealment of the seam 70 at the joist members 42.

The internal splice joint 44 can be configured such that the threaded fasteners 46 are only located at the top and bottoms of the joist members 42. Each of the joist members 42 can include a face surface 72 that extends between respective ones of the side flanges 58 and can be devoid of any fasteners, particularly along the seam 70 that might otherwise detract from the overall appearance of the lower joist assembly 30 as a continuous beam. The overall construction of the lower joist assembly 30 in this manner can accordingly be more esthetically pleasing than conventional joists that are spliced together with externally visible hardware (e.g., gussets).

Figure 8:
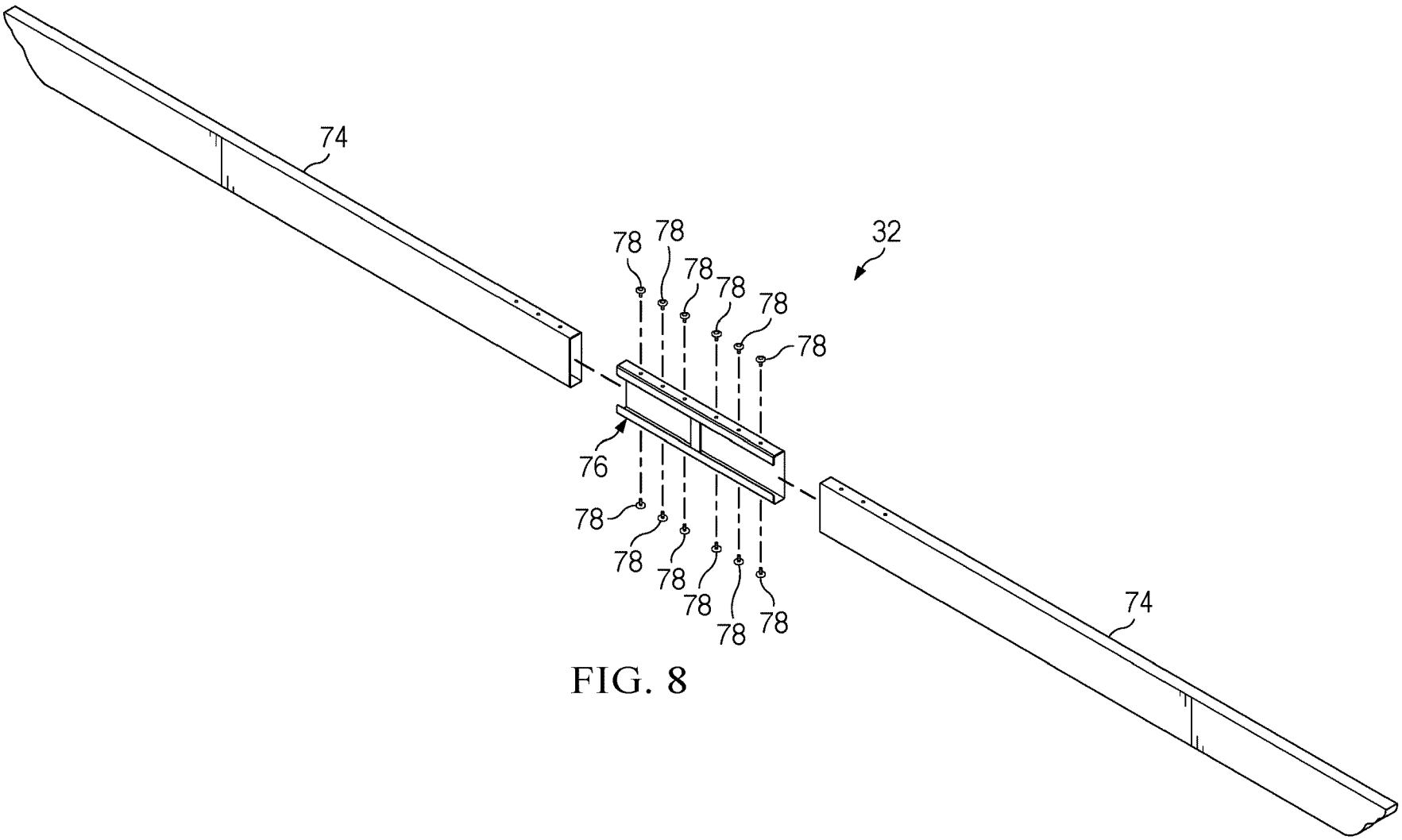
FIG. 8 is an exploded view of one of the upper joist assemblies of FIG. 1.

Referring now to FIG. 8, one of the upper joist assemblies 32 will now be described and can be understood to be a representative example of both upper joist assemblies 32 shown in FIG. 1. The upper joist assembly 32 can be similar to, or the same in many respects as, the lower joist assembly 30. For example, the upper joist assembly 32 can include a pair of joist members 74 and an internal splice joint 76 that are coupled together with a plurality of threaded fasteners 78 and can span the entire width of the pergola 20.

Figure 9:
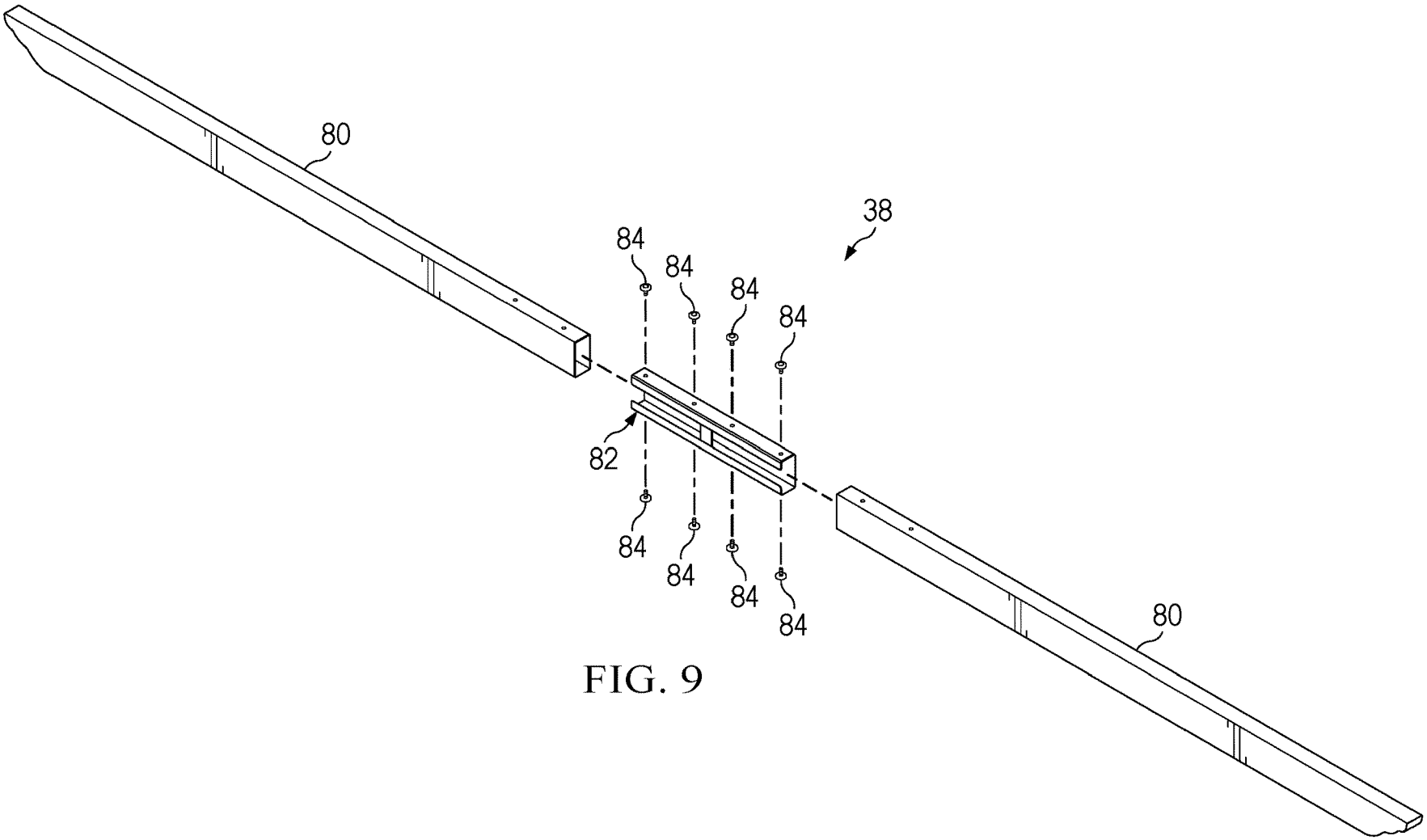
FIG. 9 is an exploded view of one of the roof joist assemblies of FIG. 1.

Referring now to FIG. 9, one of the roof joist assemblies 38 will now be described and can be understood to be a representative example of all of the roof joist assemblies 38 shown in FIG. 1. The roof joist assembly 38 can be similar to, or the same in many respects as, the lower joist assembly 30. For example, the roof joist assembly 38 can include a pair of joist members 80 and an internal splice joint 82 that are coupled tougher with a plurality of threaded fasteners 84 and can span the length or width of the roof structure 24.

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. The scope of the disclosure is, of course, not limited to the examples or embodiments set forth herein, but can be employed in any number of applications and equivalent devices by those of ordinary skill in the art. Rather it is hereby intended the scope of the invention be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A joist assembly comprising:

a pair of joist members, each joist member comprising:

a proximal end that comprises a plurality of wall portions that cooperate to define a receptacle; and a distal end; and an internal splice joint having an overall length and comprising:

a main wall that is substantially planar and has a first height;

a first side flange that extends upwardly from, and is substantially orthogonal to, the main wall;

a second side flange that extends upwardly from, and is substantially orthogonal to, the main wall and is spaced from the second side flange;

a first end flange that extends from, and is substantially orthogonal to, the first side flange and substantially orthogonal to the first side flange;

a second end flange that extends from, and is substantially orthogonal to, the second side flange; and a brace member that extends between the first end flange and the second end flange and is positioned at a center of the overall length, wherein:

the first end flange and the second end flange extend inwardly towards each other and are spaced from each other;

the internal splice joint extends into the receptacle of the proximal end of each joist member of the pair of joist members and is coupled thereto to facilitate coupling of the pair of joist members together;

the first end flange and the second end flange are spaced from each other by a second height that is less than the first height but is greater than half of the first height; and the internal splice joint is devoid of material between the first end flange, the second end flange, and the brace member.

2. The joist assembly of claim 1 wherein each joist member of the pair of joist members includes a face surface that extends between the first side flange and the second side flange and is devoid of any fasteners.

3. The joist assembly of claim 1 wherein each joist member of the pair of joist members and the brace member are formed of metal.

4. The joist assembly of claim 1 wherein the first side flange and the second side flange each define a plurality of threaded apertures that are configured to receive respective pluralities of threaded fasteners that facilitate releasable coupling of the internal splice joint and the pair of joist members together.

5. The joist assembly of claim 4 wherein the pair of joist members cooperate to define a seam and the brace member underlies at least a portion of the seam.

6. The joist assembly of claim 5 wherein:

the brace member has a length; and the overall length of the internal splice joint is about ten times greater than the length of the brace member.

7. A roof structure comprising the joist assembly of claim 1.

8. A building comprising the joist assembly of claim 1.

* * * * *